US005603198A

United States Patent [19]

Rimondi et al.

[11] Patent Number: 5,603,198

[45] Date of Patent: Feb. 18, 1997

[54] PROCESS AND APPARATUS FOR WRAPPING ARTICLES WITH STRETCHABLE FILM

[75] Inventors: Renato Rimondi, Bazzano; Angelo Cappi, Vignola, both of Italy

[73] Assignee: A.W.A.X. Progettazione e Ricerca S.r.l., Italy

[21] Appl. No.: 323,692

[22] Filed: Oct. 18, 1994

[30] Foreign Application Priority Data

Oct. 19, 1993 [IT] Italy ..... BO93A0410

[51] Int. Cl.[6] ..... B65B 53/00

[52] U.S. Cl. ..... 53/441; 53/466; 53/556; 53/228; 53/66

[58] Field of Search ..... 53/441, 466, 556, 53/228, 66

[56] References Cited

U.S. PATENT DOCUMENTS

| | | | |
|---|---|---|---|
| 3,967,433 | 7/1976 | Bonfiglioli | 53/441 |
| 4,429,514 | 2/1984 | Lancaster et al. | 53/556 |
| 4,505,092 | 3/1985 | Bowers et al. | 53/441 X |
| 4,674,269 | 6/1987 | Denda . | |
| 4,709,531 | 12/1987 | Denda . | |

FOREIGN PATENT DOCUMENTS

| | | |
|---|---|---|
| 0092759 | 11/1983 | European Pat. Off. . |
| 0569615 | 11/1993 | European Pat. Off. . |
| 1297849 | 11/1972 | United Kingdom . |

*Primary Examiner*—Linda Johnson
*Attorney, Agent, or Firm*—Larson and Taylor

[57] ABSTRACT

A stretchable film is used whose width is substantially equal to that of the bottom of an article of the largest format which can be processed by the packaging machine. The film is characterized by considerable stretchability and a low elastic memory when stretched. The portion of film cyclically introduced into the wrapping station is normally subjected to longitudinal pre-stretching which has the function of decreasing the width of the film, and the extent of this pre-stretching is variable according to the dimensions of the article to be wrapped, so that the portion of film has a width proportionate to the corresponding dimension of the article to be wrapped.

8 Claims, 8 Drawing Sheets

PROCESS AND APPARATUS FOR WRAPPING ARTICLES WITH STRETCHABLE FILM

The present invention relates to a process and apparatus for wrapping with stretchable film articles having different dimensions to form packages automatically made proportionate to the sizes of the article, in which a portion of film is fed to a wrapping station, the article is lifted against said portion of film whose flaps are then folded and extended under tension onto the base of the article according to a sequence which terminates with the folding of a final flap onto previously folded flaps.

In packaging machines of a known type, the wrapping film is unreeled from a roll and its width is generally matched to the smallest dimensions of the articles to be wrapped, to prevent the formation of random, disorganized and excessive overlapping of flaps of the film on the bottoms of the said articles of small dimensions, in order to avoid problems of an aesthetic and also a functional nature, particularly in relation to the heat-welding and sealing of the bottom of the wrapping, which is particularly necessary in the packaging of articles such as meat products, which may release liquid components over time. The larger widths of film, required for wrapping articles whose width or length is greater thatn the width of the film, are obtained by subjecting the said film to a suitable transverse pre-stretching proportionately to the dimensions of the article to be wrapped. It is evident that this condition limits the capacity of the machine to operate with articles varying over a wide range of dimensions, this being contrary to current market requirements which are for machines capable of operating automatically with articles of widely differing dimensions, without the need for adjustments or changes of format of the wrapping film.

To overcome this disadvantage, a process and equipment described in Italian patent application No. BO93A000156 (or U.S. patent application Ser. No. 08/228,096), in the name of the present applicant, have been devised, and provide for the use of stretchable film whose width is matched to the largest articles which the machine can wrap. For the packaging of articles having dimensions less than the maximum dimensions acceptable by the packaging machine, the width of the film is modified and matched in each individual case to the dimensions of the article to be wrapped, with a process and equipment for pleating, such that the longitudinal axis of the pleats is orientated in the direction of the length of the portion of film introduced into the wrapping station and such that, in the packaging of the smaller articles, the formation of a sufficiently stretched and secured wrapping is ensured in all cases.

This solution solves the probelm of forming packages automatically matched to the dimensions of the articles, but makes it necessary to use excessive quantities of film, whose special characteristic of stretchability is not exploited.

The invention is intended to overcome this problem with the following idea for a solution. The width of the film used is always proportional to that of the largest articles which the machine is to package, and for the packaging of articles smaller than the maximum size, or even for the packaging of these articles, the width of the film is matched to the dimensions of the articles to be packaged by a longitudinal pre-stretching operation. As the longitudinal pre-stretching to which the film is subjected increases, the width of the film decreases.

The longitudinal pre-stretching of the film is carried out before the film is fed to the packaging station and outside the said station, by means controlled by the systems which detect the dimensions of the article which is fed from time to time to the lifter of the machine. With this solution, the means which arrange the pre-stretched portion of film in the wrapping station are not affected by the tensions induced by the film in the pre-stretching phase. When film of considerable stretchability, reacting in a plastic way beyond certain degrees of stretching, for example polyethylene film, is used, it has been noted that the longitudinal stretch to which the film is subjected in the preliminary phase of feeding to the packaging station improves the transverse stretchability characteristics of the said film, since as the longitudinal pre-stretch increases, the transverse pre-stretch may also increase.

Further characteristics of the invention, and the advantages resulting therefrom, will become apparent from the following description of a preferred embodiment thereof, shown by way of non-lmimiting example in the figures on the accompanying sheets of drawings, in which.

Figure 1:
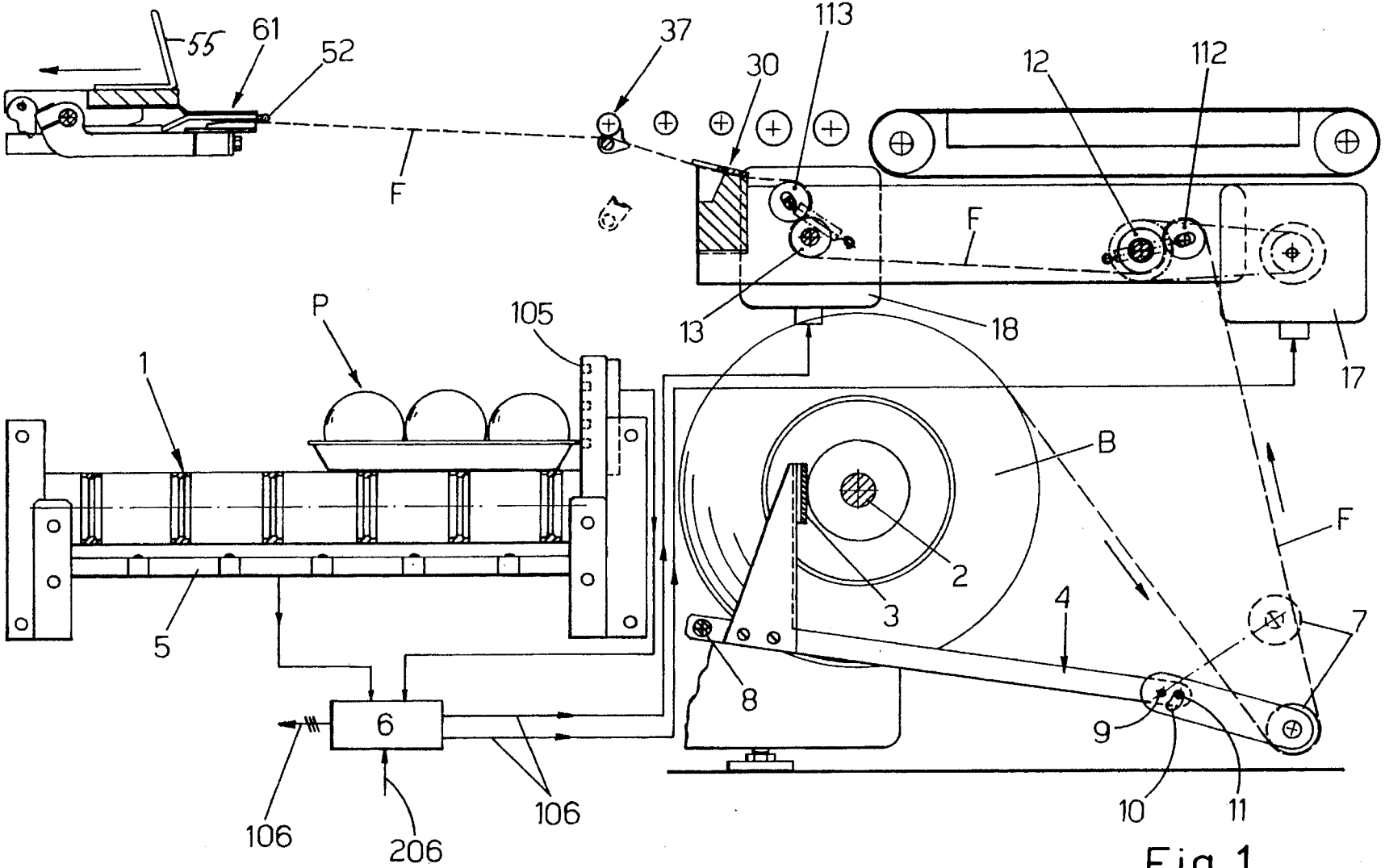
FIG. 1 is a side elevation, partly in section, of the apparatus for longitudinal pre-stretching of the film according to the invention, combined with the wrapping station of a machine for which the process described herein was especially devised.
Figure 2:
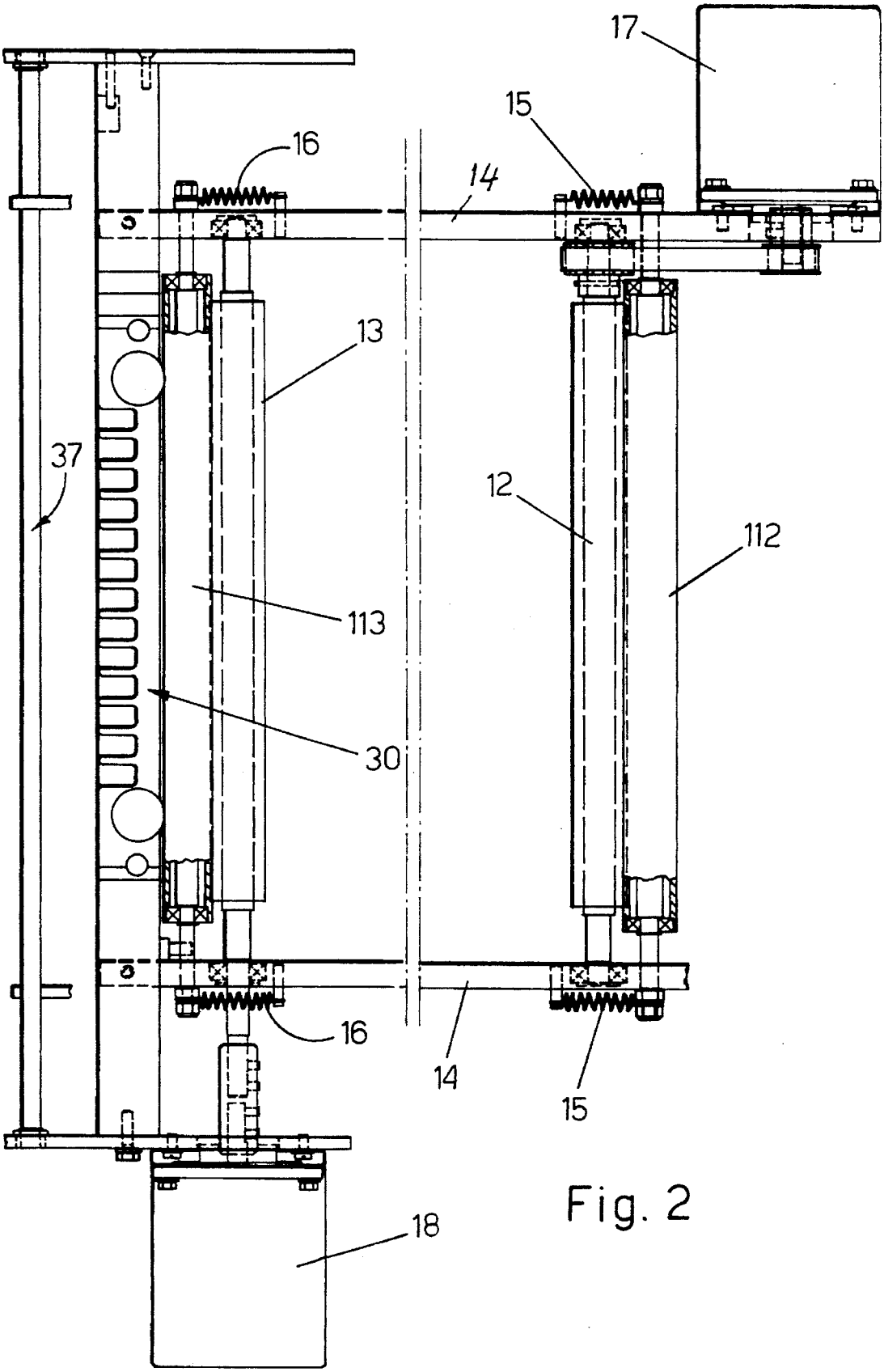
FIG. 2 is a plan view and partial section of the apparatus for longitudinal pre-stretching of the film.

FIG. 1 shows schematically the wrapping station of a machine according to Italian patent application No. GE93A000028 (or U.S. patent application Ser. No. 08/215,646) filed in the name of the present applicant, in which a portion of film F is cyclically unreeled from a roll B and is spread at the wrapping station, with a portion whose length is matched to the dimensions and characteristics of the article P to be wrapped. Before being introduced into the wrapping station by the corresponding feed conveyor 1, the article P is scanned by at least two groups of banks 5–105 of optoelectronic sensors disposed transversely and below and at the sides of the path of the article, and which, in combination with at least one electronic computer 6, detect the three dimensions of the article, the width, the height and the length (s), the last of these being deduced, the constant value of the advancement speed (v) of the article carried by the conveyor 1 being known, from the equation ($s=v \cdot t$), where (t) is the time of shadowing of at least one of the sensors of any one of the said banks 5 and 105. The outputs 106 of the computer 6 control the electric motors of the mechanisms driving the various operating units of the machine, including the electric motors of the apparatus or equipment for longitudinally pre-stretching the wrapping film, which will be described in greater detail subsequently. The number 206 indicates an optional input terminal to supply to the computer 6 any necessary variables relating to the characteristics of the article to be wrapped and/or any necessary characteristics of the film used.

Figure 6:
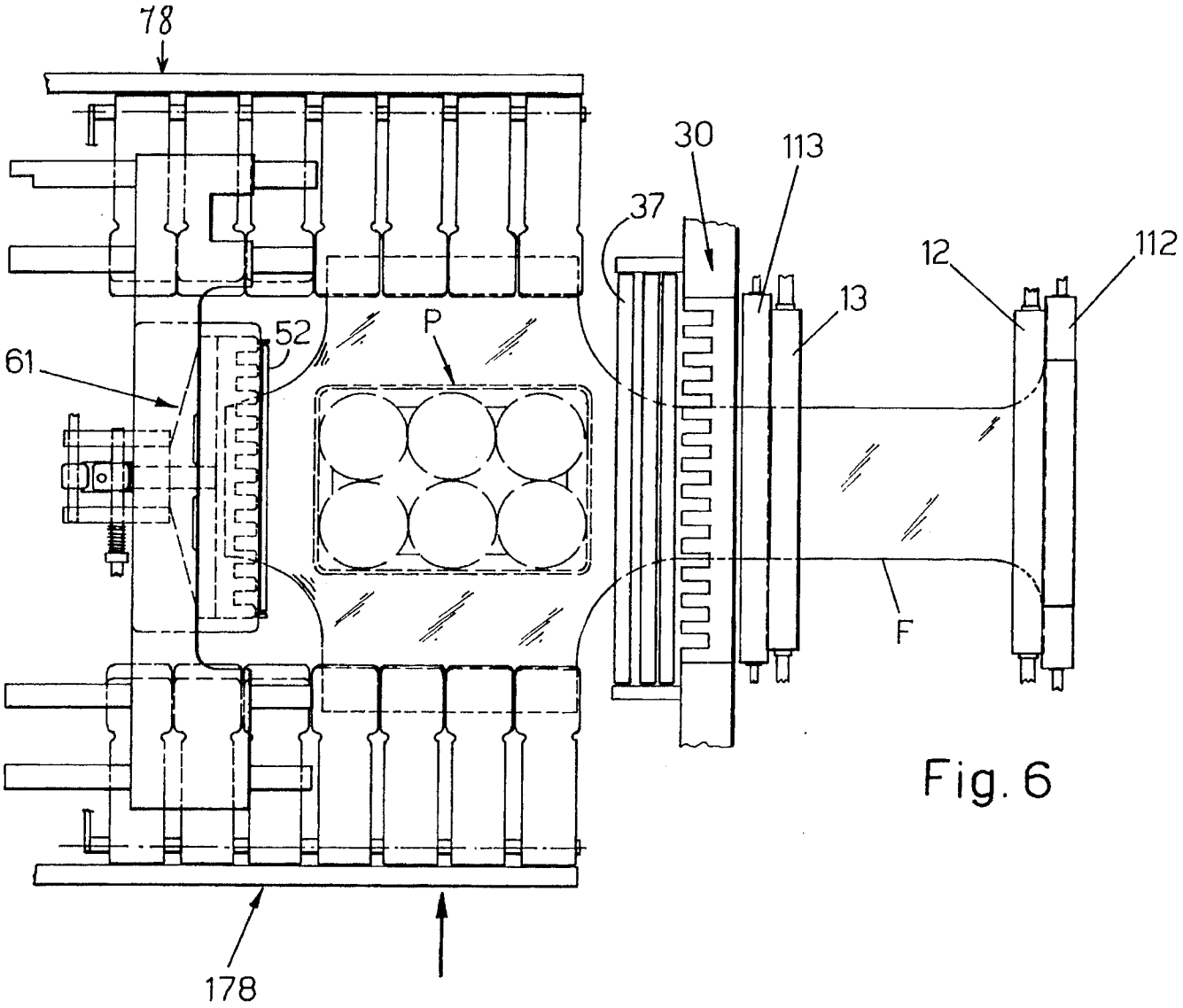

The portion of film unreeled from the roll B and spread in the wrapping station (FIGS. 1–5) is held at one end by a fixed comb-like dispenser 30 and is held at the other end by a comb-like clamp 61 movable parallel to the said dispenser. A part of this portion of film, whose length is matched to the dimensions of the article to be wrapped, is gripped on command by the side clamps 78–178 (FIG. 6) which then move apart from each other with a self-centring movement, to subject the film to a transverse pre-stretching to an extent proportionate to the dimensions of the article. In the subsequent phase of the lifting of the article against the pre-stretched film (FIG. 7), the rear clamp 61 (FIG. 6) and the dispenser 30 with the corresponding associated means (see below) slacken appropriately the longitudinal tension of the film, and in addition the side clamps approach each other to attenuate the pre-stretch and are then inserted under the article (FIG. 8) and open to spread the side flaps L1 and L2 of the film (FIGS. 11–12) under the article. The rear folder 52 which spreads the flap of film L3 held by the associated rear clamp 61, and the pusher 55 (FIGS. 8–9–10) which pushes the article on to the front folder 37 then come into operation jointly, while a further flap of film L4 is drawn from the fixed dispenser 30 (FIGS. 11–12–13) and is spread on the bottom of the article over the whole length and cut to size by means (not illustrated) operating immediately downstream of the dispenser 30 and is disposed under the side flaps and rear flap of the wrapping film which is released at the correct time by the said rear clamp 61.

For the application of such a process of wrapping articles or of all those processes in which it is necessary to use film which leaves the dispenser 30 or other similar feeding unit with a variable width matched on an individual basis to the dimensions of the article, in such a way that the flaps L3 and L4 have a width falling within the width of the bottom of the article, the following provisions have been made.

Use is made of a roll B of stretchable film, whose width is matched to the dimensions of the largest articles which the packaging machine has to wrap. The width of the film will be substantially equal to, or preferably slightly greater than, the width of the said largest articles, so that, even in the packaging of these articles, the film will have to be subjected to longitudinal pre-stretching (see below). The film used will preferably be characterized by high stretchability and a low elastic memory when pre-stretched. Stretchable films of polyethylene and/or other suitable plastics material, for example, may be used for this purpose.

The roll B of the stretchable film (FIG. 1) is supported rotatably about its own axis by means of any known type, for example by a hub 2 whose rotation is controlled by a brake 3 associated with the arm 4 of a buffer roller 7, the said arm being pivoted at 8 to a fixed supporting part and being formed by two parts hinged together at 9 in the intermediate portion, the section of arm supporting the buffer roller 7 being provided with a slot 10 concentric with the hinge 9 and engaged by a pin 11 integral with the other section of arm. With this solution it is possible to delay and advance the operation of the brake 3, in the phases of raising and lowering of the buffer roller respectively, so that the section of film passing around the buffer roller is always tensioned longitudinally. On leaving the buffer roller 7, the film is run around a first pair of parallel rollers 12–112 and between a second pair of parallel rollers 13–113 spaced at a suitable distance from the first, all being parallel to the axis 2 of the roll B and syupported rotatably at their ends by a suitable fixed frame 14 (see below). The siad pairs of rollers are disposed so that the film F passes around the rollers in a winding path and consequently has a large contact surface. Of each pair of rollers, at least the rollers 12 and 13 are rubber-coated or made in such a way that they have a sufficiently high coefficient of friction with respect to the film. The rollers 12 and 13 are supported rotatably by the frame 14 in a fixed position while the rollers 112–113, which preferably have smooth hard surfaces, of steel for example, are supported by the same frame with the possibility of moving away from the former rollers, against which they are pressed by springs 15 and 16 which interact between fixed points of the frame and the ends of the axes of the rollers 112–113 which in this way compel the film to adhere closely and uniformly to the rubber-coated rollers. The rubber-coated rollers 12 and 13 are driven by motors 17 and 18 respectively at an electronically controlled speed, interfaced with the outputs 106 of the computer 6.

The pair of rollers 13–113 is disposed immediately upstream of the dispenser 30 which is designed to hold the end of the film fed from the said pair of rollers.

Figure 3:
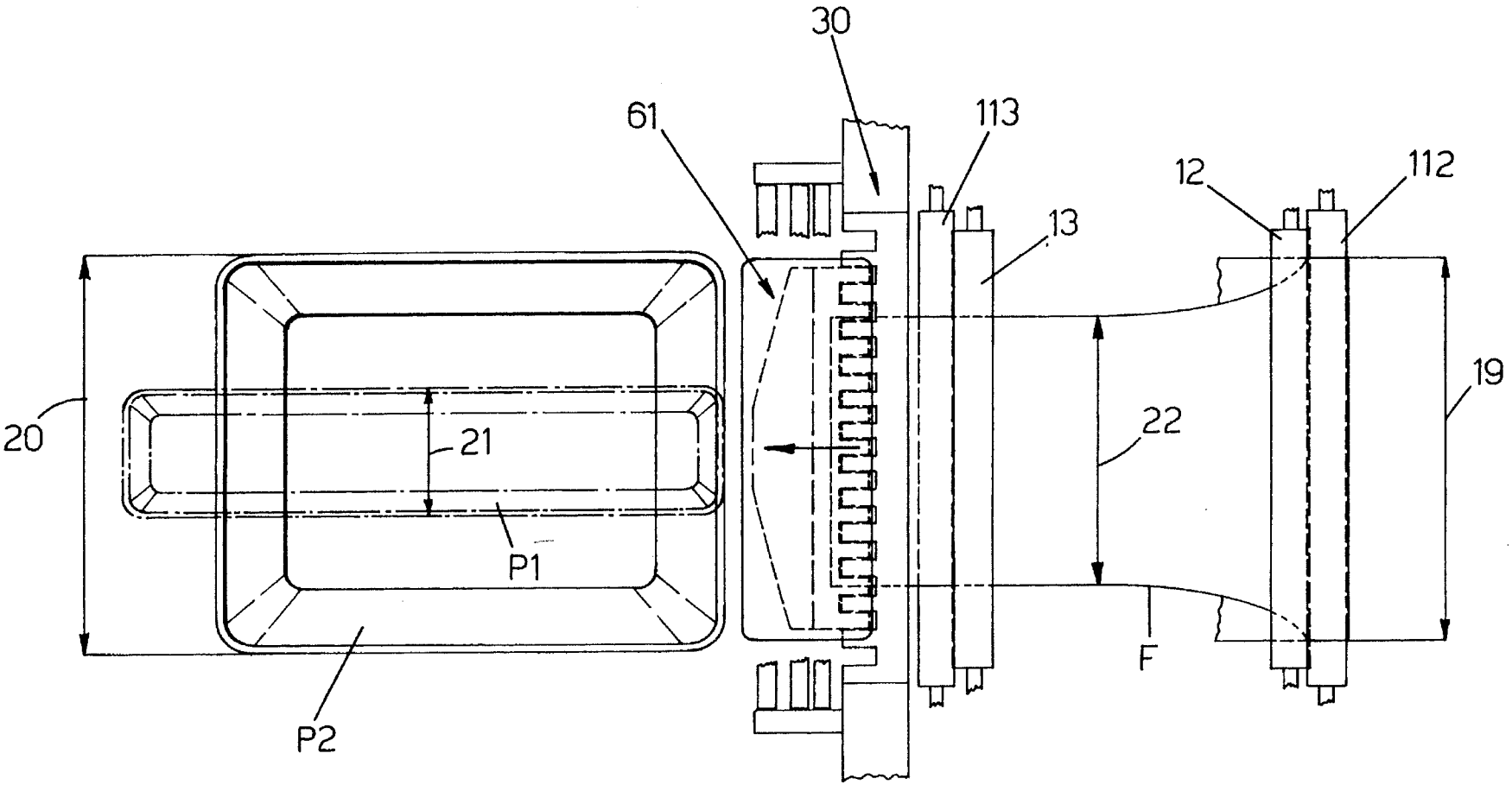
FIG. 3 is a plan view of the station for wrapping the article and the means for longitudinal pre-stretching of the film, together with the articles of maximum and minimum format which can be packaged by the machine, the film at the dispenser presenting the width usable for packaging any format of article within the limits shown.

In FIG. 3 it will be seen that the width 19 of the film used is directly proportionate to the width 20 of the largest article P2 to be wrapped. Also in FIG. 3, the reference numeral 21 indicates the width of the smallest article P which can be wrapped by the said packaging machine.

Figure 4:
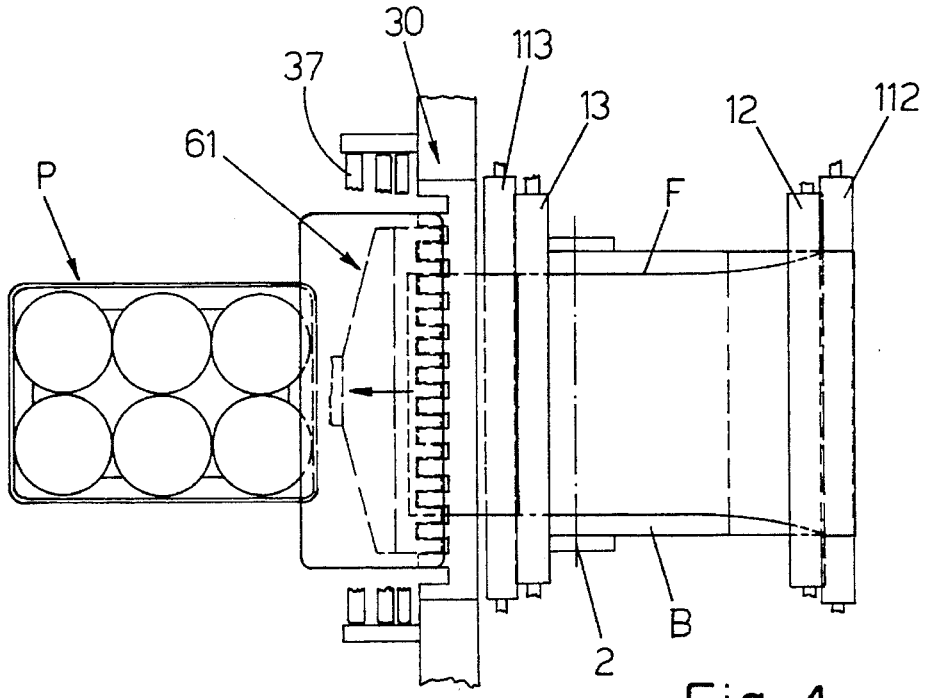
FIGS. 4–5–6 are plan views of the apparatus for longitudinal pre-stretching of the film and of the wrapping station of the machine is successive phases of an operating cycle.
Figure 5:
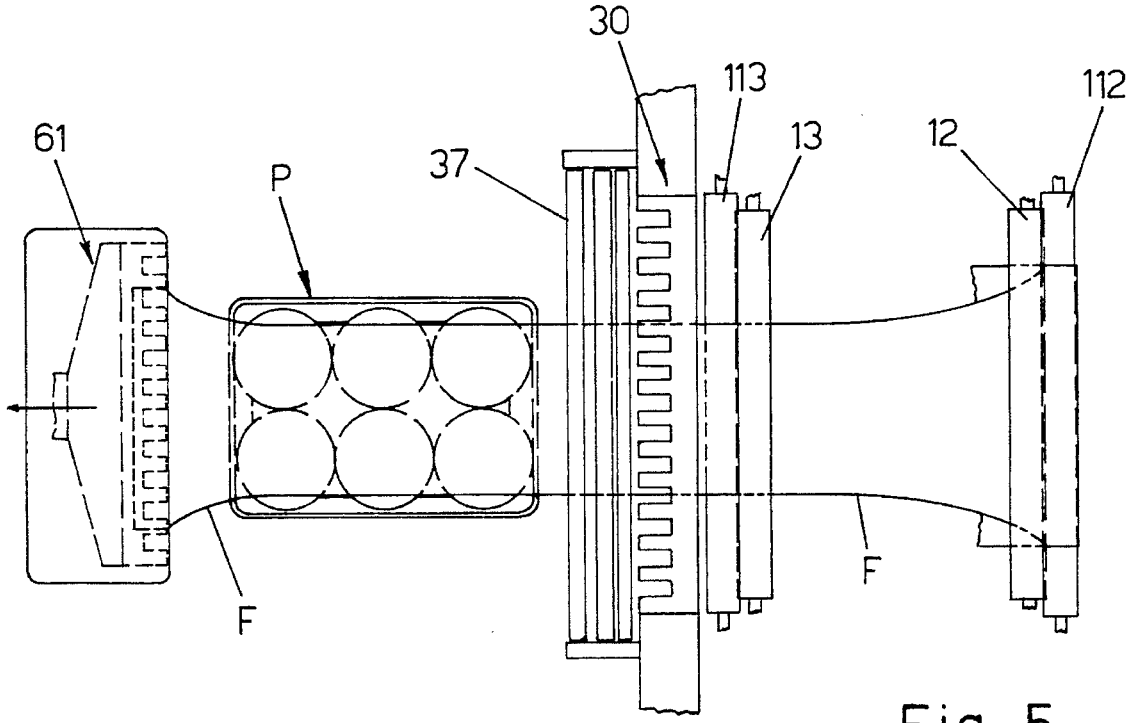

The above described equipment operates as follows. When the article P is introduced into the packaging station by the conveyor 1, the dimensions of the article are detected by the banks 5–105 and the computer 6 prepares the machine to operate according to these dimensions. In FIG. 4 it will be seen that the clamp 61 grips the end of the film held by the dispenser 30 and moves back over a distance proportional to the corresponding dimension of the article. In this phase, the pair of rollers 13–113 rotates in the correct direction for the feed of film to the dispenser, with a peripheral speed substantially equal to that of the backward movement of the clamp, and stops when the said clamp stops. The pair of rollers 12–112 may initially remain stationary and/or may also start to rotate immediately, in the correct direction for the feed of film to the dispenser, but at a lower speed than that of the downstream rollers, so that the portion of film between the two pairs of rollers is subjected to a longitudinal pre-stretch such that the width of the said portion of film is progressively made to be substantially equal to or suitably less than the width of the bottom of the article to be wrapped. The stress of the longitudinal pre-stretching of the film is borne solely by the pairs of rollers 12–112 and 13–113. The portion of film leaving the dispenser 30 is already pre-stretched longitudinally by the necessary amount, has a low elastic memory and therefore remains securely and correctly held by the clamp 61, which is not subjected to any particular stress. Since, according to the characteristics of the film used, the reaction of the film to the longitudinal stretching and the consequent reduction in the width of the film are known, it will be possible to match the width of the film fed to the article wrapping station, simply by suitably controlling the ratio between the speeds of the pairs of rollers 12–112 and 13–113. This is done by the computer 6 which, as previously stated, has been provided with the dimensions of the article to be wrapped.

The portion of film introduced (drawn) by the clamp 61 in the wrapping station of the machine, owing to the longitudinal pre-stretching to which it has been subjected before introduction into the said station, has a molecular lattice uniformly stretched in this direction, so that, when the said portion of film is pre-stretched in the transverse direction as mentioned below and the longitudinal tension is appropriately attenuated, the said portion of film reacts to the said transverse pre-stretch uniformly, without forming transverse puckering or concentrations of weak spots in the transversely pre-stretched area. As a general rule, it has been found that, an increase in the pre-stretching of the film in the longitudinal direction increases the pre-stretching to which it can be subjected in the transverse direction.

When the film has been introduced into the wrapping station of the machine, the side clamps 78–178 (FIG. 6) come into operation with a self-centring movement of approach to each other, to grip side portions of the said portion of film, with a length proportionate to that of the article, after which the said clamps move away from each other, with a self-centring movement, to subject the film to a degree of transverse pre-stretching proportionate to the dimensions of the article P. As stated previously, in this phase the rear clamp 61 approaches the article by a suitable amount and, if necessary, the film feed unit is appropriately operated so as to feed a suitable quantity of film to the dispenser 30.

Figure 7:
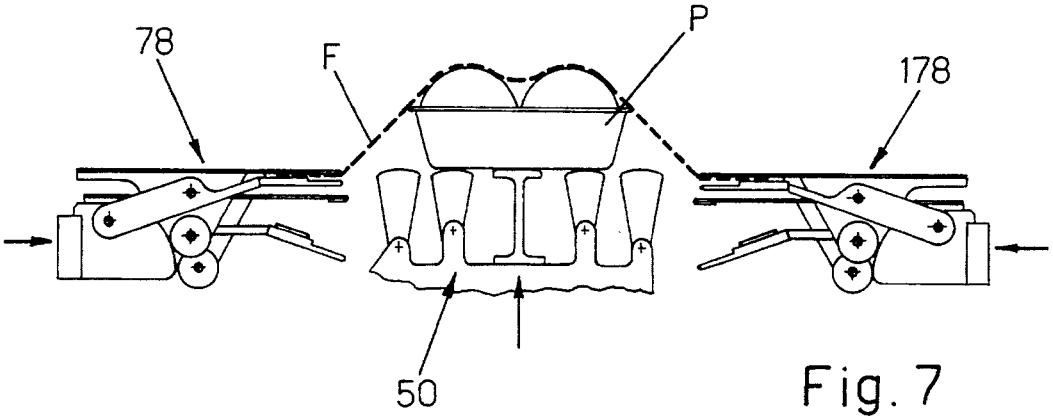
FIG. 7 shows the wrapping station of the machine in transverse section and in a phase of operation following that shown in FIG. 6.
Figure 8:
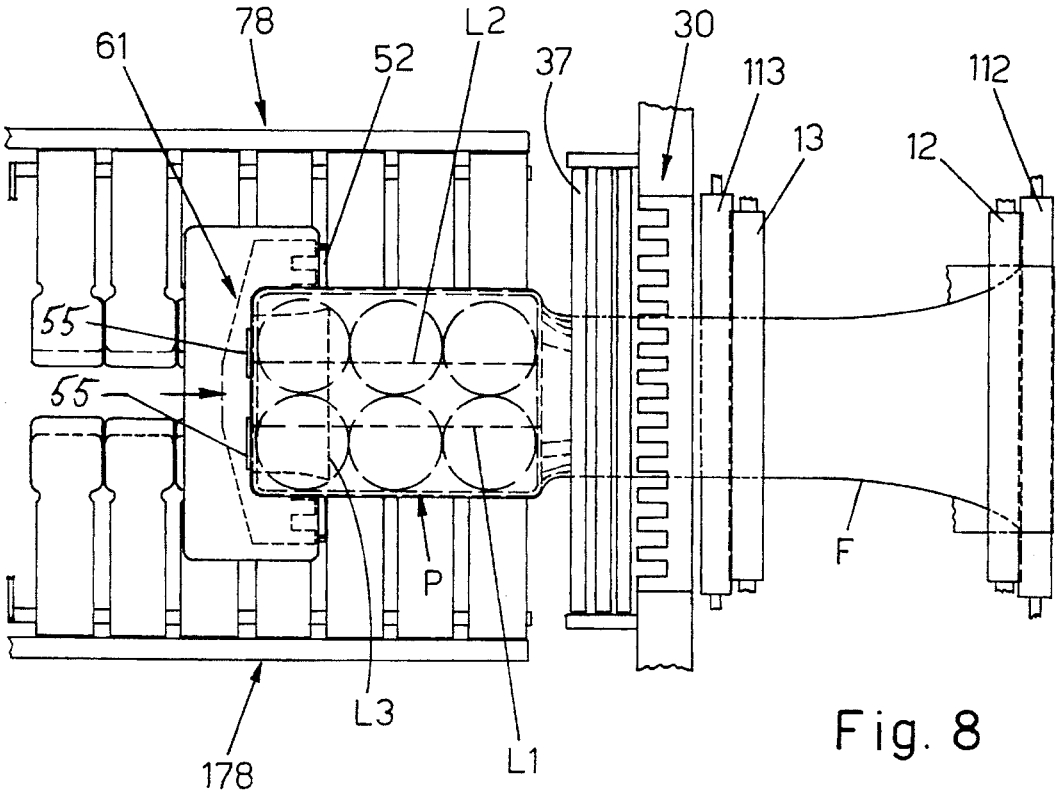
FIGS. 8–9–10 are plan views of the apparatus for longitudinal pre-stretching of the film and of the wrapping station of the machine in successive and concluding phases of an article wrapping cycle.

On completion of the transverse pre-stretching, the lifter 50 lifts the article P against the pre-stretched portion of film, while the longitudinal and transverse tension of the film are appropriately attenuated, as stated previously with respect to the transverse pre-stretching, and now with an appropriate movement of the side clamps 78–178 towards each other (FIG. 7).

Figure 11:
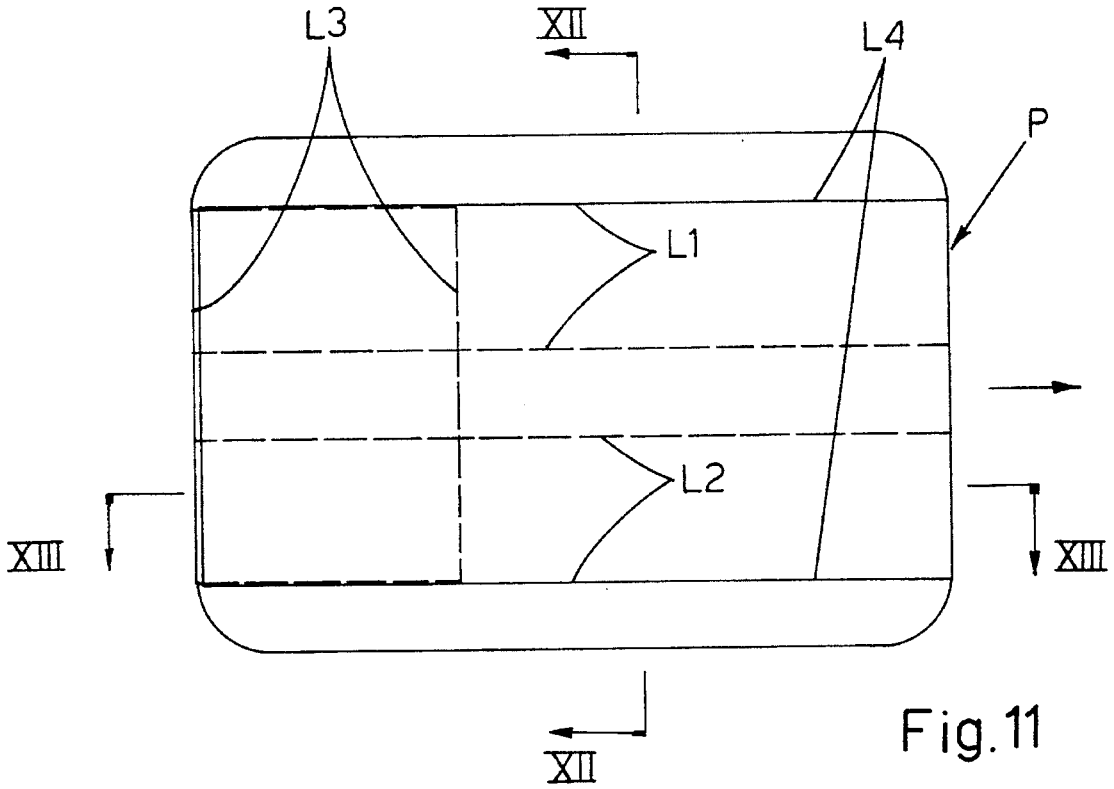
FIG. 11 is a plan view from below of an article packaged by the process and by the means according to the invention.
Figure 12:
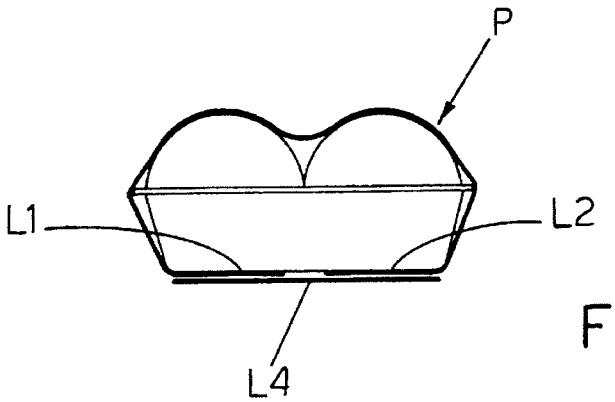
FIGS. 12–13 show two details of the packaged article as shown in FIG. 1, taken on the sectional lines XII—XII and XIII—XIII.
Figure 13:
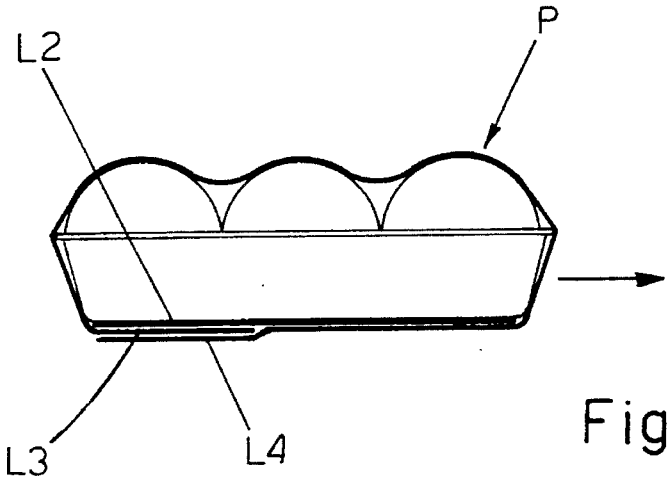

In strict sequence, the side clamps continue their movement towards each other, are inserted under the article (FIG. 8) and then open to spread the side flaps L1–L2 of the film under the article (FIGS. 11–12). The rear clamp 61 then comes into operation, being inserted under the article and, with the attached folder 52, spreads the rear flap L3 of the film under the article and under a section of the said side flaps (FIGS. 11–13). On the rear clamp 61 there is mounted the pusher 55 which comes into contact with the article and which, while the said clamp moves towards the dispenser 30, pushes the article towards and over the front folder 37. In this phase, the rear flap L3 is still held by the clamp 61, which opens only in the concluding part of the discharge path of the article.

In the same phase, the pair of rollers 13–113 is driven with a peripheral speed substantially equal to that of the movement of the clamp, being driven almost immediately at the start of the discharge movement of the article, if the article has to be handled delicately, while if the article is sufficiently strong and rigid the driving of the said pair of rollers may start with an appropriate delay with respect to the start of the movement of the article. The rollers 12–112 are driven at a speed suitably slower than that of the downstream rollers, so that the portion of film between the two pairs of rollers driven at different speeds is subjected to a longitudinal stretch which matches its widthe to that of the article. The rear flap L4 which completes the wrapping of the article leaves the rollers 13–113 and the dispenser 30, being appropriately pre-stretched in the lognitudinal direction and having a width falling within the width of the botttom of the article, so that it is disposed under the side flaps L1–L2 and under the rear flap L3 in the best condition to be fixed subsequently by heat-welding to the said flaps.

Figure 9:
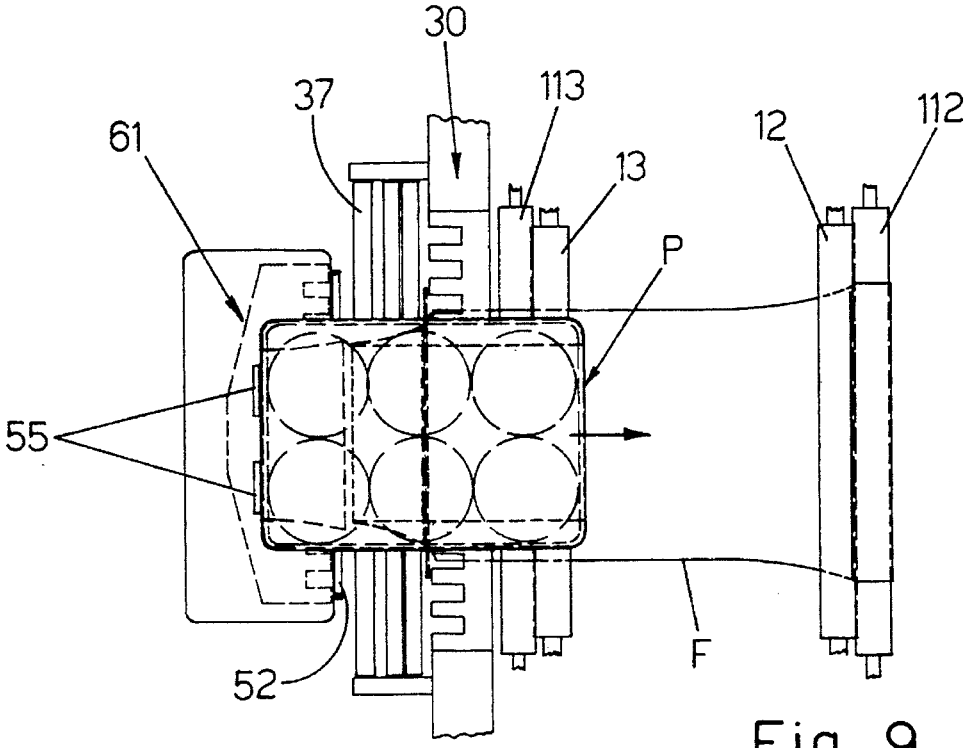
Figure 10:
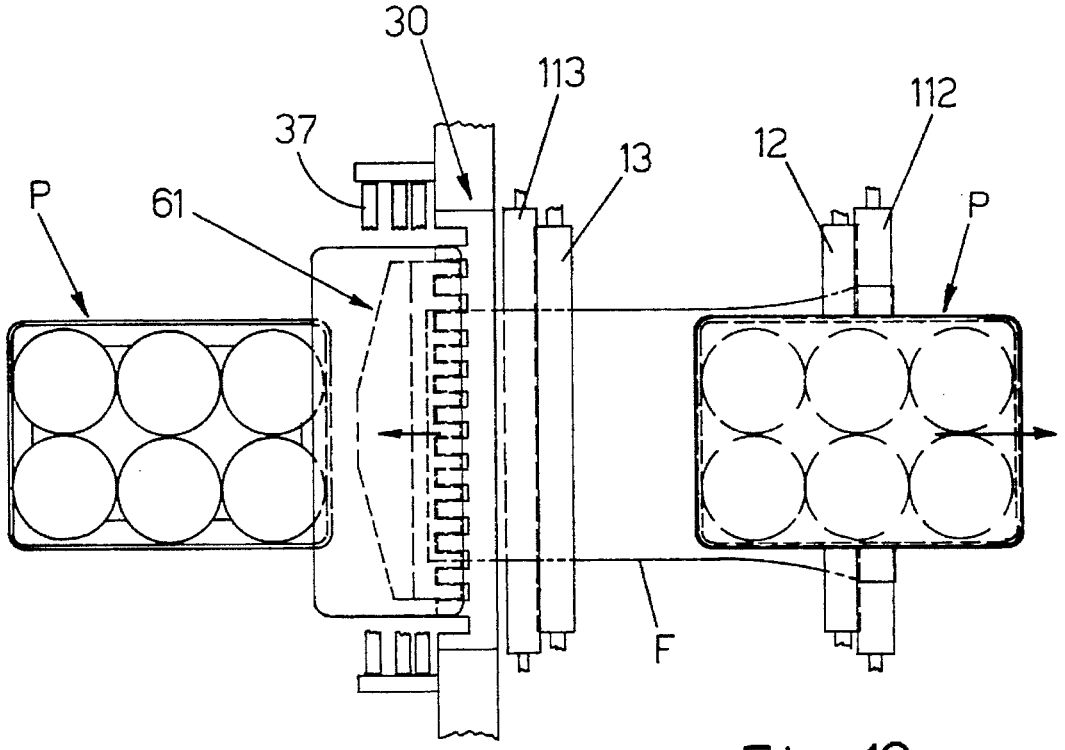

In FIG. 9 it will be seen that, before the quantity of film necessary for completion of the flap L4 leaves the dispenser, the speed of rotation of the rollers 12–112 is modified automatically if necessary by the computer 6, so that, before the flap L4 is separated by the cutting means operating immediately downstream of the dispenser 30 (and not illustrated), the film is engaged into the said dispenser 30 with a width 22 lying between that necessary for the packaging of the articles of maximum and minimum width, as indicated by 20 and 21 in FIG. 3 and as illustrated in FIG. 10. According to a variant embodiment, the matching to the mean value of the film width, as described above, may be done only when the computer 6 does not detect the presence of a following article in or near the wrapping station, or detects the presence in the wrapping station of an article having dimensions different from that whose wrapping is being completed, while, if the following articles has dimensions equal to the preceding one, it is possible not to modify the width of the film in the dispenser 30.

We claim:

1. A process for successively wrapping individual articles having different dimensions using a stretchable film comprising the steps of:

determining a largest width dimension of all of the articles to be wrapped;

measuring dimensions of a next article to be wrapped;

adapting at a pre-stretching station a width of the film proportionally to a measured width dimension of the next article having a smaller width than said largest width dimension by pre-stretching said film in a longitudinal direction which is parallel to a length of the film, in order to decrease the width of the film in a lateral direction; and feeding said longitudinally pre-stretched film from said pre-stretching station to a wrapping station where said film is folded onto the article, wherein the wrapping station is separately located from said pre-stretching station and the pre-stretching step precedes the feeding step and these steps are independent of each other.

2. Process according to claim 1, wherein the stretchable film has a width suitably greater than that of the bottoms of all of the articles so that the longitudinal pre-stretching step stretches the film to the bottom of the articles.

3. Process according to claim 1, wherein stretchable film of considerable stretchability and low elastic memory when stretched is used.

4. An apparatus for wrapping successive articles with stretchable film which articles have different dimensions to form packages automatically made proportionate to the sizes of the article, where the article is lifted against said portion of film whose flaps are then folded and extended under tension onto the base of the article according to a sequence which terminates with the folding of a final flap onto previously folded flaps, said film having a width which is proportionate to that of the largest size of articles which can be handled in the wrapping operation, comprising:

a wrapping station;

a film feed roll;

measuring means for measuring the dimensions of the article fed to the wrapping station of the machine and which transmits these data to at least one computer unit which controls the operation of the apparatus;

means for longitudinally pre-stretching the portion of the film which operates at a pre-stretching station located between said film feed roll and the wrapping station of the packaging machine, the location of said pre-stretching means being physically separated from a location of the wrapping station, said longitudinal pre-stretching means being controlled by said computer unit, to subject the portion of film, which is introduced into said station for wrapping the article, to a longitudinal pre-stretching operation which modifies the width of said film according to the dimensions of the article to be wrapped, so that the portion of film fed to said station and held at one end by a dispenser and at the other end by a clamp movable with respect to said dispenser, has a width matched on an individual basis to that of the article to be wrapped.

5. An apparatus according to claim 4, wherein said means for longitudinal pre-stretching comprise at least two pairs of rollers which are parallel and superimposed on each other, in which each pair of rollers comprises:

a first stationary roller, covered with or made from a material such that its surface has a sufficiently high coefficient of friction in relation to the film, said rollers being connected to any suitable power source controlled by the computer, a second smooth roller being made of a material, and elastic means for pushing said second smooth roller against said first stationary roller, such that the film is run around said first stationary rollers so that it contacts a large portion of the circumference, said two pairs of rollers being driven at different speeds so that the portion of film lying between them is subjected to longitudinal pre-stretching in order to alter the width of the film.

6. An apparatus according to claim 5, wherein one pair of pre-stretching rollers is located at a short distance from and parallel to a comb-like dispenser which holds the end of the wrapping film from time to time, said pair of rollers being cyclically driven with a peripheral speed substantially equal to the linear speed of movement of said clamp which initially introduces the film into the wrapping station and which then, with an attached folder, folds on to the bottom of the article a rear flap of the film and with an attached pusher pushes the article to discharge it, while a final flap of film is folded on to its bottom, the other pair of pre-stretching rollers being made to be suitably spaced from the preceding pair of rollers and being operated in such a manner that the portion of film running between the two pairs of rollers is subjected to longitudinal pre-stretching which is necessary in each individual case for matching the width of film to the dimensions of the article to be wrapped.

7. An apparatus according to claim 6, comprising means for operating concurrently said pair of pre-stretching rollers locking near the dispenser with a return movement of the rear clamp which introduces a new portion of film into the wrapping station of the packaging machine, and means for operating at the conclusion of a wrapping cycle said rollers at one of when a pusher associated with said clamp starts to move the article to discharge it or a precise delay after this start.

8. An apparatus according to claim 5, wherein rollers of the pairs of pre-stretching rollers are operated by corresponding electric motors at an electronically controlled speed, connected with a suitable interface to the computer responsible for the automatic operation of the packaging machine.

* * * * *